US006161621A

United States Patent [19]

Daly et al.

[11] Patent Number: 6,161,621

[45] Date of Patent: Dec. 19, 2000

[54] SCRUBBER FOR AN OIL-ONLY RECOVERY APPARATUS

[76] Inventors: LeGrand A. Daly, P.O. Box 1351, Graham, Tex. 76450; Wayne A. Blad, 23949 State Rd. 23, South Bend, Ind. 46614

[21] Appl. No.: 09/294,900

[22] Filed: Apr. 21, 1999

[51] Int. Cl.[7] ..... E21B 43/16

[52] U.S. Cl. ..... 166/369; 166/67; 166/75.1

[58] Field of Search ..... 166/369, 67, 68.5, 166/75.1

[56] References Cited

U.S. PATENT DOCUMENTS

| | | | |
|---|---|---|---|
| 988,301 | 4/1911 | Bessonnet-Favre | 198/643 |
| 1,007,282 | 10/1911 | Hawley | 198/643 |
| 1,703,963 | 3/1929 | Scruby | 198/642 |
| 3,774,685 | 11/1973 | Rhodes | 166/369 |
| 4,712,667 | 12/1987 | Jackson et al. | 198/643 |
| 4,861,384 | 8/1989 | Jackson | 134/9 |
| 5,016,708 | 5/1991 | Baer et al. | 166/75.1 |
| 5,232,051 | 8/1993 | Daly | 166/369 |
| 5,348,137 | 9/1994 | Palmer | 198/643 |
| 5,381,861 | 1/1995 | Crafton et al. | 166/77 |

*Primary Examiner*—Hoang Dang
*Attorney, Agent, or Firm*—R. Tracy Crump

[57] ABSTRACT

An improved scrubber that uses a stream of air to blast the oil off the oil-laden conveyer chains of oil-only recovery apparatus is disclosed. The improved scrubber eliminates the need for conventional scouring components that physically contact the conveyer chain. The scrubber includes a blower, a series of air ducts, and an elongated nozzle. The air flow generated by the blower is communicated through the air ducts and directed onto a length of the oil-laden conveyer chain within the reservoir chamber of the recovery apparatus by the nozzle to blast the crude oil off the conveyer chain. The scrubber also includes a collection baffle positioned directly behind the length of the conveyer chain, which provides a surface area upon which the liquid oil collects and upon which the gaseous oil particulate may agglomerate and condense, before collecting at the bottom of the reservoir chamber. The scrubber of this invention can be used as part of an open or closed air circulation system on an oil-only recovery apparatus.

14 Claims, 4 Drawing Sheets

SCRUBBER FOR AN OIL-ONLY RECOVERY APPARATUS

This invention relates to oil-only recovery apparatus used for mature, low production oil wells, and in particular an improved scrubbing mechanism that removes the oil collected on the continuous conveyer chain of the recovery apparatus.

BACKGROUND OF THE INVENTION

U.S. Pat. No. 5,232,051 describes a continuous oil-only recovery apparatus for recovering oil from mature, low production wells that are normally abandoned once further oil production becomes uneconomical. The oil-only recovery apparatus pulls a continuous conveyer chain suspended in a well borehole through the oil stratum to draw oil from the stratum and deposit the collected oil in a reservoir. Capillary, electrical or chemical attraction causes the oil to attach to the links of the chain. The oil laden chain is pulled to the surface where the oil is removed from the chain for collection by a scouring mechanism, referred to as a scrubber.

The continuous conveyer chain mechanism has proven to be a highly efficient means for drawing crude oil from mature, low production wells; however, the scouring mechanisms used to remove the oil from the conveyer chain, heretofore, have not been efficient enough to make the use of oil-only recovery apparatus practical or economical for well operators. The problem being that the conventional scouring mechanism or scrubbers fail to remove sufficient quantities of oil at chain speeds that were optimal for drawing sufficient quantities of oil to the surface. Scrubbers have used various mechanical means, including steel wool, brushes, scrapers, wipers and the like, which physically brush and scrape the attached oil from the links of the conveyer chain. A casing packed with steel wool through which the oil-laden conveyer chain passed has, heretofore, been the most successful scouring mechanism. The steel wool within the casing physically scrapes, brushes and scours the oil from the links. Typically, these scrubbers fail to make sufficient contact with the chain to remove enough oil to be commercially viable. The physical scouring components, whether steel wool, brushes, scrapers or wipers of any type, quickly become saturated with oil and lose any degree of effectiveness that they may have had in removing the oil from the conveyer chain. Consequently, much of the crude oil drawn from the well was not removed from the chain, and therefore returned back into the well with the conveyer chain. In order to make continuous oil-only recovery apparatus commercially viable, practical and economically efficient scrubbers are needed.

SUMMARY OF THE INVENTION

The improved scrubber of this invention uses a stream of air to blast the oil off the conveyer chains of oil-only recovery apparatus. The improved scrubber eliminates the need for conventional scouring components that physically contact the conveyer chain. The scrubber includes a blower, a series of air ducts, and an elongated nozzle to generated the air stream, which blasts the crude oil from the oil laden conveyer chain. The air stream from the blower is directed into the enclosed reservoir chamber of the recovery apparatus through the air duct. The nozzle applies the air stream over a length of the conveyer chain as it is drawn up through a column connected to the well head. The scrubber also includes a collection baffle positioned directly behind the conveyer chain. The collection baffle is a series of expanded metal plates which provide a surface area upon which the liquid oil collects and upon which the gaseous oil particulate may agglomerate and condense, before collecting at the bottom of the reservoir chamber. The scrubber of this invention can be used in an open or closed air circulation system as necessary. In an open system, the blower draws air from the atmosphere for application against the chain, which is then vented back to the atmosphere through a filter. The filter prevents gaseous oil particulate from being vented into the environment, which may cause enviornmental concerns. In a closed system, the air is re-circulated back to the blower in the closed environment of the recovery apparatus.

Accordingly, an advantage of this invention is that the improved scrubber can consistently and efficiently remove oil from the conveyer chain and make oil-only recovery apparatus economically viable to operators of mature, low production oil wells, thereby avoiding their abandonment and the loss of their reserves.

Another advantage of this invention is that the improved scrubber blasts the oil from the conveyer chain using a directed stream of air.

Another advantage of this invention is that the scrubber eliminates the need for brushes, scrapers, wipers and scouring components to physically contact the conveyer chain.

Another advantage of this invention is that the improved scrubber can be used in an open or closed loop air circulation system.

Other advantages will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

Figure 1:
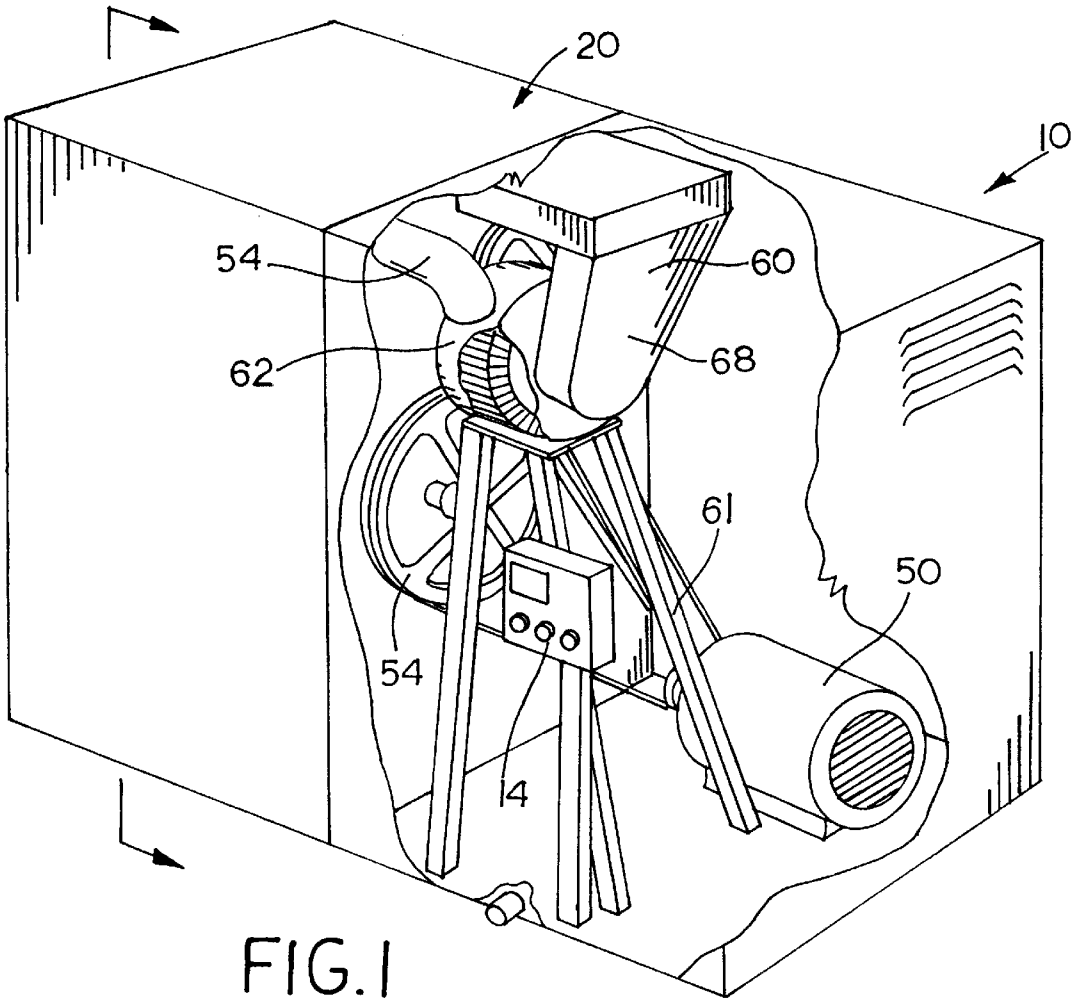
FIG. 1 is a perspective view of a continuous oil-only recovery apparatus using the improved air blast oil scrubber of this invention.

The preferred embodiments herein described are not intended to be exhaustive or to limit the invention to the precise form disclosed. They are chosen and described to best explain the invention so that others skilled in the art might utilize its teachings.

FIGS. 1–4 illustrate a recovery apparatus using the improved scrubber of this invention in a closed loop air circulation system. Recovery apparatus 10 shown and described herein follows the general teachings of the recovery apparatus described in U.S. Pat. No. 5,232,051. Recovery apparatus 10 is mounted to the well head 4 of an conventional oil well. Recovery apparatus 10 includes a reservoir housing 20, a conveyer drive assembly 40 and a scrubber assembly 60. The operation of conveyer assembly 40 and scrubber assembly 60 can be controlled by control panel 14, which employs conventional controls well known in the art.

Figure 2:
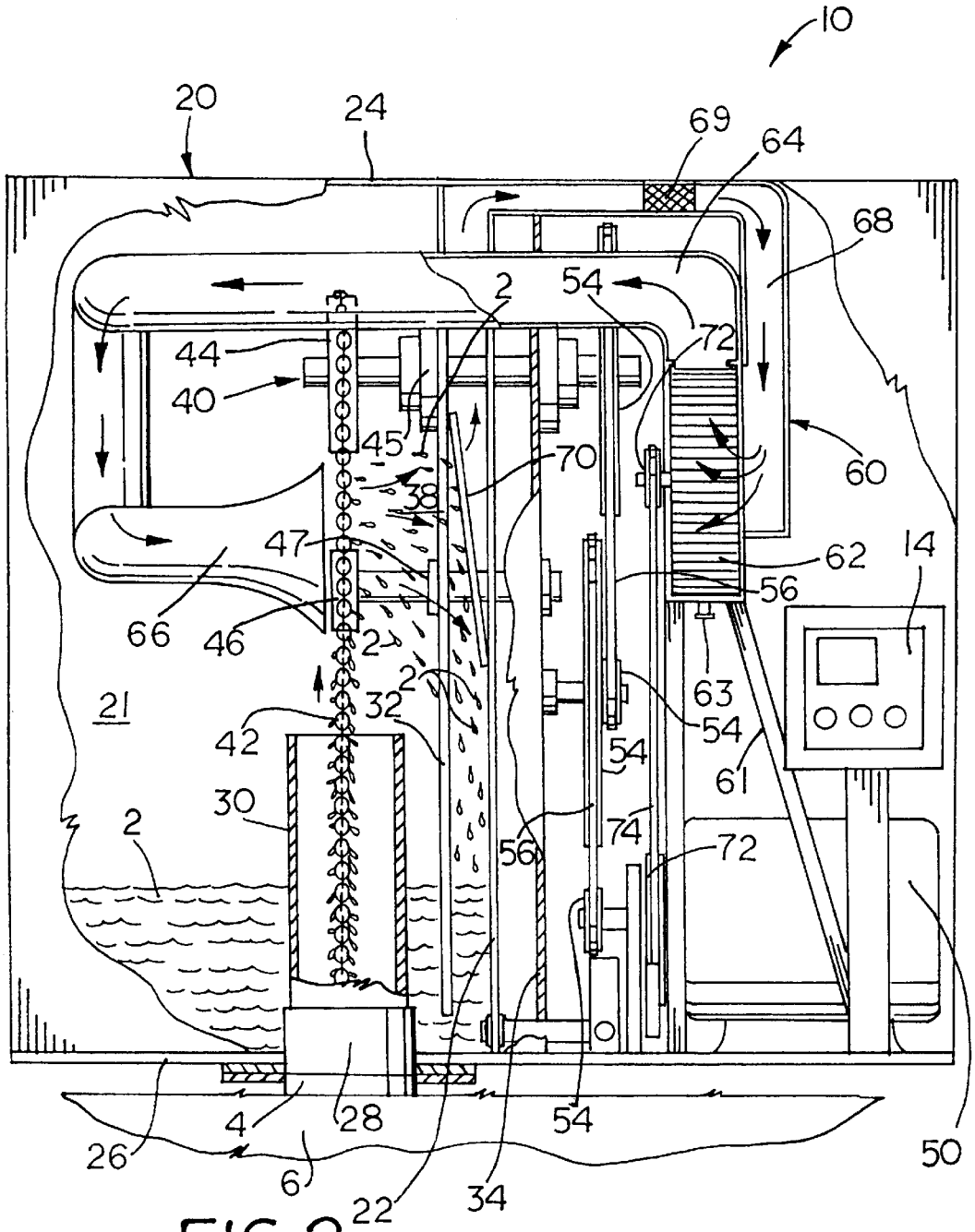
FIG. 2 is a side sectional view of the continuous oil-only recovery apparatus using the improved air blast oil scrubber of this invention, illustrating a closed air circulation system.
Figure 3:
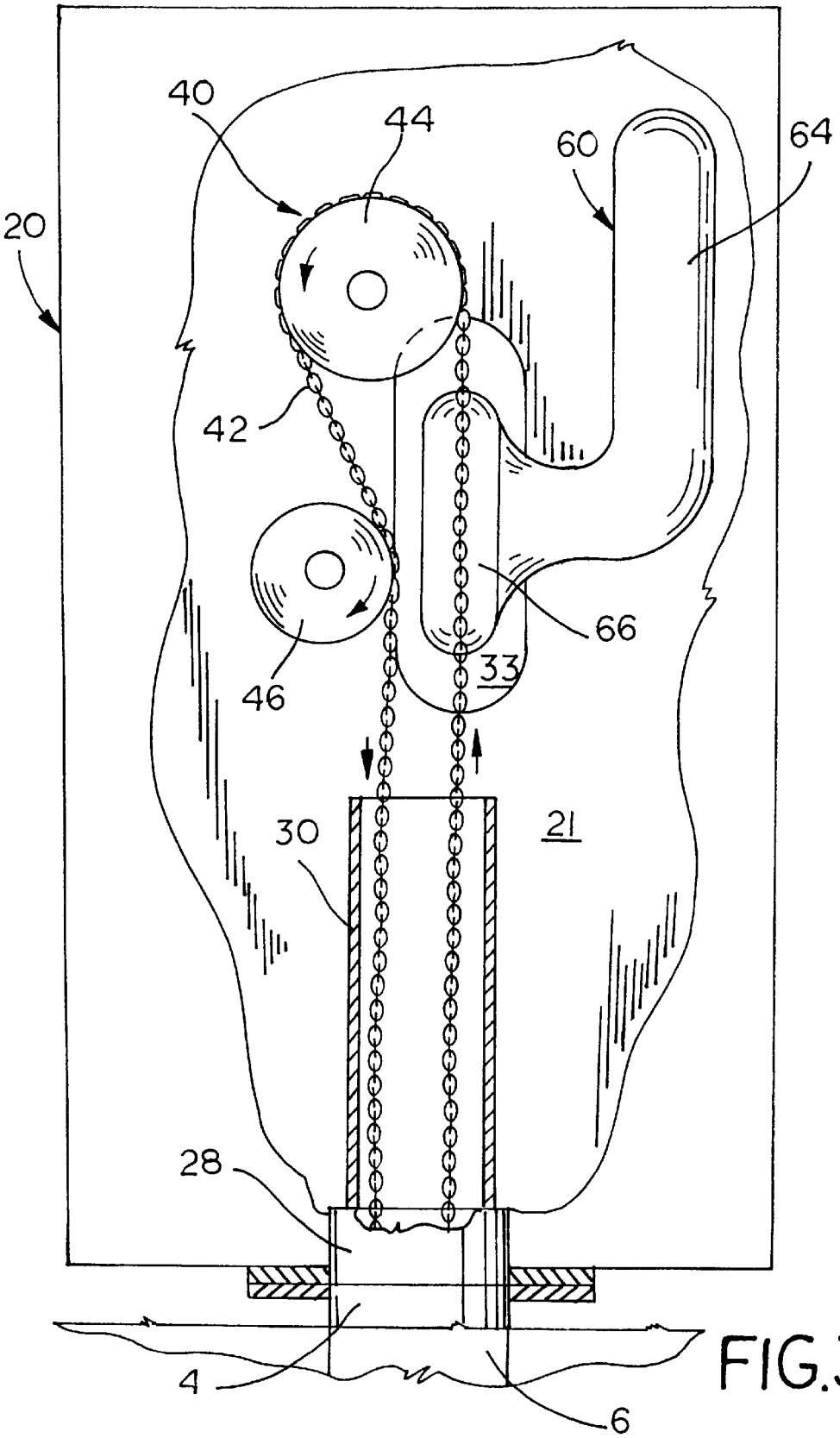
FIG. 3 is an end sectional view of the continuous oil-only recovery apparatus using the improved air blast oil scrubber of this invention.

As best shown in FIGS. 2 and 3, reservoir housing 20 includes an enclosed reservoir tank formed by side walls 22, a top wall 24, an bottom wall 26, which defines an inner reservoir chamber 21. A mounting collar 28 is connected to bottom wall 26, which allows recovery apparatus 10 to be mounted to well head 4. A tubular reservoir column 30 extends from collar 28 upwardly into reservoir chamber 21. Reservoir housing 20 also includes inner and outer support walls 32 and 34, which support conveyer assembly 40. As shown in FIGS. 2 and 3, the lower end of inner support wall 32 is spaced above bottom wall 26 to partially divide reservoir chamber 21. Inner support wall 32 has an opening 33 formed above the upper end of reservoir column 30. An outlet port 36 and line 38 are connected in communication with reservoir chamber 21 and serve to impel oil in reservoir chamber 21 to a separate storage tank (not shown).

Conveyer assembly 40 includes continuous conveyer chain 42, a drive sprocket 44, and idler sprocket 46 supported within reservoir chamber 21, a counter weight (not shown), that is lowered into the well casing 6, and drive motor 50 and various transmission components mounted outside of reservoir housing 20. Conveyer chain 42 is trained about a drive sprocket 42 and a pulley of the counter weight (not shown) lowered into the well casing. Drive sprocket 42 is mounted within reservoir chamber 21 above column 30 by bearing blocks 45 mounted in support walls 32 and 34. Idler sprocket 46 is mounted within reservoir chamber 21 between drive sprocket 44 and the mouth of column 30 also by bearing block 47 mounted in support walls 32 and 34. Motor 50 is of conventional design and is mechanically connected to transfer rotational movement to drive sprocket 44 by a series of pulleys 54 and belts 56. In addition, conveyer assembly 40 may include any combination of clutches, gears, shear pins and other devices necessary to regulate the speed of the conveyer chain 42. Motor 50 turns drive sprocket 44 to move conveyer chain 42 up and down well casing 6. The length of the conveyer chain is sufficient that the counter weight is positioned below the oil stratum. As the conveyer chain is moved through the oil stratum, oil attaches to the links of the chain by capillary attraction and is drawn up to the surface.

Scrubber assembly 60 includes a blower 62, outlet and return air ducts 64 and 68, an elongated nozzle 66, and a collection baffle 70. As shown in FIGS. 1–4, scrubber assembly 60 is used in a closed loop air circulation system, which re-circulates the air flow within reservoir chamber 21. Blower 62 is of any conventional design. Ideally, the blower generates a constant air flow of at least 25 cubic feet per minute, but the required flow rate depends on the viscosity of the crude oil being recovered and the conveyer speed, and does not change the scope of this invention. As shown, blower 62 is supported on sub-frame 61 and is driven by motor 50. Blower 62 is mechanically connected to motor 50 by pulleys 72 and drive belt 74, which transfers the rotational movement of the motor to the blower. Although shown as being powered by motor 50, blower 62 may be independently powered without changing the scope of this invention. The exhaust port of blower 62 is connected to the proximal end of outlet duct 64, which communicates the airflow from the blower into reservoir chamber 21. Nozzle 66 is connected to the distal end of outlet duct 64 inside the reservoir chamber 21. Collection baffles 70, which act as a collection upon which oil particulate may collect, are mounted diagonally directly behind opening 33 between inner support wall 32 and side wall 12. Collection baffles 70 are formed by expanded metal plates. The configuration of the expanded metal plates provides geometric structures for the oil particulate to strike and adhere to. Collection baffles 70 also serve to slow the air flow and oil particulate. In addition, return air duct 68 connects reservoir chamber 21 to the inlet port of blower 62, which provides a closed loop air re-circulation system. Return air duct 68 includes a filter 69, which removes any gaseous oil particulate from the air drawn back into blower 62. Since some oil particles may pass through filter 69 to blower 62, the blower has a drain port 63, which allows any oil collected to be drained.

Scrubber assembly 60 uses a stream of air to blast the oil 2 from the conveyer chain. Nozzle 66 directs the air stream against a length of oil-laden conveyer chain 42 as it emerges from column 30 inside reservoir chamber 21. Oil 2 blasted from conveyer chain 42 strikes and collects on collection baffles 70 and flows to the bottom of reservoir chamber 21. Depending on the viscosity of oil 2, the scrubbing process of blasting conveyer chain 42 with a stream of air will create some gaseous oil particulate. The scrubbing process blows most of the liquid and gaseous oil particulate from conveyer chain 42 through opening 33 in inner support wall 32 onto collection baffles 70. The large surface area of collection baffles 70 provides sufficient structural surface upon which most of the oil particulate may condense. The oil particulate condenses on collection baffles 70 and eventually settles in the bottom of reservoir chamber 21. Oil 2 collected in the reservoir chamber 21 may then be pumped to a separate storage container through outlet port 36 and line 38. As shown in FIG. 2, blower 62 draws air from reservoir chamber 21 through return duct 68 and filter 69. The placement of return air duct 68 adjacent end wall 22 creates a slight air draw behind inner support wall 32 that creates an air flow through opening 33 and thereby helps to draw oil particulate toward collection baffles 70.

Figure 4:
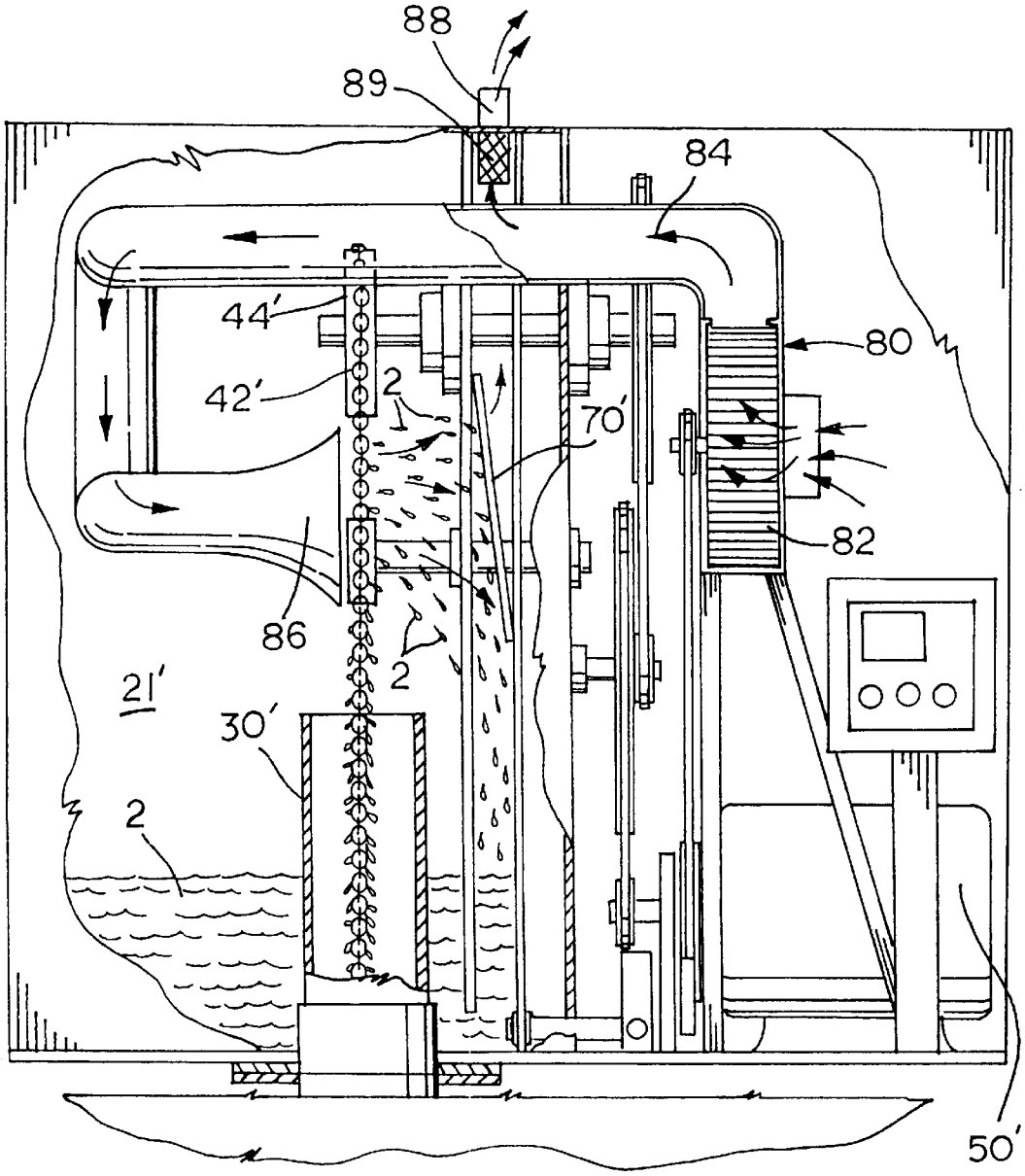
FIG. 4 is a side sectional view of the continuous oil-only recovery apparatus using the improved air blast oil scrubber of this invention, illustrating an open air circulation system.

FIG. 4 shows an alternate embodiment of scrubber assembly 80 as part of an open loop air circulation system. Scrubber assembly 80 follows the basic mechanical design and mechanism, except that no return duct is connected between the reservoir housing and blower. Scrubber assembly 80 includes a blower 82, outlet air ducts 84, an elongated nozzle 86, and a collection baffle 70'. Again, blower 82 is supported on sub-frame 61' and is driven by motor 50'. As an open circulation system, blower 82 draws and vents air from the atmosphere. The one-way inlet port of blower 82 draws air directly from the atmosphere and exhaust air is vented to the atmosphere from reservoir chamber 21' through a one-way exhaust port 88 and a filter 89.

It is understood that the above description does not limit the invention to the details given, but may be modified within the scope of the following claims.

We claim:

1. An improved oil-only recovering apparatus (10) for mature low production oil wells including a continuous conveyer chain (42) suspended in the well casing (6) upon, drive means (40) for moving the conveyer chain within the oil casing through the oil stratum to draw oil attached to the conveyer chain to the surface, means (60) for removing oil from the conveyer chain, and reservoir means (20) for collecting oil, the improvement comprising the oil removing means (60) applying an air flow onto a length of the conveyer chain to remove the oil attached to the conveyer chain.

2. The improvement of claim 1 wherein oil removing means includes blower means (62) for creating the air flow, and means (64, 66, 68, and 69) for communicating the air flow onto a length of the conveyer chain.

3. The improvement of claim 2 wherein the communicating means includes an elongated nozzle (66).

4. The improvement of claim 3 wherein the communicating means includes a first duct (64) for communicating the air flow between the blower means and nozzle (66) within the reservoir means (20) and a second duct (68) for recirculating the air flow back to the blower means (62) in a closed loop air circulation system within said recovery apparatus.

5. The improvement of claim 4 wherein the second duct includes means for filtering oil from the air flow before the air flow is re-circulated into the blower means.

6. The improvement of claim 3 wherein the communicating means includes a first duct for communicating the air flow between the blower means and nozzle means within the reservoir chamber in an open loop air circulation system in the recovery apparatus.

7. The improvement of claim 1 wherein the oil removing means also having means for accumulating oil removed from the conveyer chain.

8. The improvement of claim 7 wherein the accumulating means includes a baffle plate, the baffle plate positioned within the reservoir housing adjacent the conveyer chain such that the baffle plate slows the air flow and oil removed from the conveyer chain accumulates and condenses on the baffle plate.

9. The improvement of claim 4 wherein blower means has means for draining oil collected therein from the air flow circulated to the blower from the reservoir chamber.

10. An apparatus for removing oil from on mature low production oil wells comprising: a continuous conveyer chain extending into the well; and scrubber means for applying an air flow onto a length of the conveyer chain to blast oil from the conveyer chain.

11. The apparatus of claim 10 wherein scrubbing means includes blower means for creating the air flow, and means for directing the air flow onto a length of the conveyer chain to blast the oil from the conveyer chain.

12. The apparatus of claim 11 wherein directing means includes an elongated nozzle, and duct means for communicating the air flow between the blower means and the nozzle.

13. A method of removing oil for collection from an oil-laden continuous conveyer chain in an oil-only recovery apparatus for oil wells, comprising the steps of:

a) providing scrubber means for creating an air flow;

b) moving the oil-laden conveyer chain from the oil well past the scrubber means; and c) applying the air flow onto a length of the oil-laden conveyer chain to blast the oil from the conveyer chain.

14. The method of removing of claim 13 also includes a step d) providing means for accumulating the oil removed from the conveyer chain by the air flow.

* * * * *